US007982376B2

(12) United States Patent
Keen et al.

(10) Patent No.: US 7,982,376 B2
(45) Date of Patent: Jul. 19, 2011

(54) APPARATUS AND METHOD FOR REMOVING HEAT FROM HIGH INTENSITY LIGHT BULBS

(75) Inventors: Stephen B Keen, Elgin, TX (US); Thomas E. Marek, Austin, TX (US)

(73) Assignee: Thomas Marek, Austin, TX (US)

( * ) Notice: Subject to any disclaimer, the term of this patent is extended or adjusted under 35 U.S.C. 154(b) by 107 days.

(21) Appl. No.: 12/442,159

(22) PCT Filed: Sep. 21, 2007

(86) PCT No.: PCT/US2007/079205

§ 371 (c)(1), (2), (4) Date: Mar. 20, 2009

(87) PCT Pub. No.: WO2008/036930

PCT Pub. Date: Mar. 27, 2008

(65) Prior Publication Data

US 2010/0207499 A1 Aug. 19, 2010

(51) Int. Cl.
*H01J 7/26* (2006.01)

(52) U.S. Cl. ..... 313/35; 313/12

(58) Field of Classification Search ..... 313/11, 313/22, 24, 26, 25, 35
See application file for complete search history.

(56) References Cited

U.S. PATENT DOCUMENTS

| | | | | |
|---|---|---|---|---|
| 4,101,424 | A * | 7/1978 | Schooley et al. | 250/504 R |
| 5,147,130 | A | 9/1992 | Watanuki | |
| 5,504,666 | A | 4/1996 | Carmichael | |
| 6,595,662 | B2 | 7/2003 | Wardenburg | |
| 7,441,915 | B2 | 10/2008 | Shouse et al. | |

* cited by examiner

*Primary Examiner* — Joseph L Williams

(57) ABSTRACT

Water or air is directed through a hood or double cylinder cooling device for providing cooling to one or more light bulbs used in growing plants in greenhouses, aquarium, and hydroponic applications. A water recirculation system with a reservoir and a pump may provide a flow of cooling water through tubing to the hood. The hood provides a housing and a tube which contains one or more light bulbs which can be accessed or replaced through an end of the tube which projects through the housing. The light holder includes an enclosed electric box and a plurality of curved fins which expand against the inside glass tube. Various reflector housing shapes and reflectors direct light to plants. The end cap is bolted to a split ring flange attached to the outer tube.

23 Claims, 22 Drawing Sheets

FIG. 1- PRIOR ART

FIG 2- PRIOR ART

FIG 3- PRIOR ART

APPARATUS AND METHOD FOR REMOVING HEAT FROM HIGH INTENSITY LIGHT BULBS

RELATED APPLICATIONS

This application is related to PCT/US2007/079205, also published as WO2008036930, which claims priority from U.S. patent application Ser. No. 11/524,572 filed Sep. 21, 2006.

FIELD OF THE INVENTION

The current invention relates to a method and apparatus for light bulb heat dissipation devices. In particular, the invention relates to a circulating liquid cooling device and method for greenhouses, aquarium, and hydroponic applications.

BACKGROUND—PRIOR ART

The availability of light is a major factor in the ability to grow plants in greenhouse or hydroponic applications. Typically, very strong lights, such as 1000 watt bulbs are used for these applications. It is desirable to remove heat from the vicinity of these bulbs in order to avoid damage to plants.

The intensity of light on a given surface area drops by the square of the distance from the light source. It is desirable to place the light source close to the plant in order to direct light efficiently to the plant. The strong lights generate large amounts of heat that can damage the plants. Therefore it is usually necessary to provide a cooling device for the bulbs to remove heat so that the bulbs may be placed in reasonable proximity to the plants.

The prior art includes air cooled and water cooled devices.

Hydro-Coil

The Hydro-Coil is a handcrafted a water cooled tubular glass coil made from high temperature borosilicate glass. It is fitted over a High Intensity Discharge (HID) lamp. In operation, water is pumped through the vessel. The water absorbs the radiant heat emitted by the lamp. The retail price for the coil is about $390.

The device is typically used in combination with a reservoir kit such as a 20 Gallon reservoir, a submersible pump, and ½" tubing. A water chiller may be added to obtain additional cooling.

U.S. Pat. No. 5,147,130

U.S. Pat. No. 5,147,130 issued to Watanuki on Sep. 15, 1992 for "Cooling liquid recirculation system for light source unit" describes a cooling liquid recirculation system with walls of transparent jacket tubes for cooling a mercury-vapor lamp, The jacket tubes are provided separately from the lamp, and are formed in optical filters to decrease the temperature of an object to be illuminated. A recirculation unit of cooling liquid for recirculation of the jacket tubes is connected through an elastic duct to a light source unit such as a mercury-vapor lamp. These components are movable for practical use.

U.S. Pat. No. 5,504,666

U.S. Pat. No. 5,504,666 issued to Carmichael on Apr. 2, 1996 for "Light bulb cooling jacket and heat dissipation system" describes a light bulb cooling jacket which is adapted to confine a light bulb in a space through which cooling liquid, such as water, may be circulated. The light bulb cooling jacket includes a shell having a rim, the rim defining an opening in the shell. A stopper fits in the opening in the shell and seals against the rim of the shell. The 5 stopper has an aperture in it. The aperture is adapted to receive a portion of a light bulb, which is held and sealed in place in the aperture. The means employed to hold the bulb in place is adapted to engage a generally cylindrical portion of the light bulb, such as the neck of a standard 1000 W bulb. An important characteristic of the invention that follows from this construction is that the light bulb cooling jacket may be used with a variety of standard high intensity light bulbs. Ports are provided in the stopper for introducing and withdrawing cooling liquid from the 10 space enclosed by the shell and the stopper.

U.S. Pat. No. 6,595,662

U.S. Pat. No. 6,595,662 issued to Wardenburg on Jul. 22, 2003 for "Double-walled grow light housing with air flow cooling system" describes a grow light having an exterior shell with an air inlet and a hot air exhaust outlet, and a specular interior insertable into the shell. The sides of the specular insert are spaced apart from the walls of the shell so as to form a double-walled housing having air cooling chambers and vents which facilitate the movement and exhaust of air heated by high intensity light bulbs.

SUMMARY OF INVENTION

The present invention provides improved methods and apparatus for providing liquid or air fluid cooling to grow and aquarium lights.

In one embodiment, a water recirculation system is provided which includes a reservoir and a pump which provides a flow of cooling water through tubing to a cooling hood.

The hood provides a housing and a tube which contains one or more light bulbs. Each light bulb can be accessed or replaced through an end of the tube which projects through the housing. In one example, a relatively large volume of coolant fluid is contained between the housing and the outside of the tube. In one example, the fluid is approximately 3 gallons of water. The fluid volume provides a safety factor during operation so that the bulb may continue to operate for some period after a pump failure.

In other examples, smaller hoods are used to reduce the volume of water and thereby reduce the weight of the device. A pressure relief valve may be provided at or near the hood to prevent excessive pressure in the cooling hood.

In another embodiment, either water or air coolant may be used.

In an embodiment, a cylindrical cooling device is provided, where one or more light bulbs are placed within an inner cylinder, and water or other coolant is circulated between the inner cylinder and an outer cylinder. In one example, these cylinders are glass, and end caps are provided to seal the annular space between the cylinders, to provide hose connections to supply and return coolant to the space, to suspend or otherwise support the device, and to permit easy access to change the light bulbs. In one example, the device is designed with inlet and outlet ports located on the upper end of the device so that coolant is maintained in the device, and the device is less likely to shatter from the re-introduction of coolant against a hot inner cylinder. A high pressure relief valve is typically provided as an additional safety feature.

DETAILED DESCRIPTION OF EMBODIMENT—WATER COOLED HOOD

One embodiment of the current invention is the Hydroflector™ water-cooled hood. This embodiment provides a hood which can retain coolant to reduce the likelihood of shattering glass elements caused by introducing or re40 introducing coolant in the vicinity of a hot lamp. The retention of coolant in the hood in the event of pump or piping failure provides a safety feature. The relatively large volume of coolant will remove heat from a lamp with only a slow temperature rise. As coolant flow is reestablished, there is less shock to the system. This embodiment also provides a good thermal efficiency of heat removal, and a high growth efficiency for plants which receive light with a minimum of extra heat.

Figure 1:
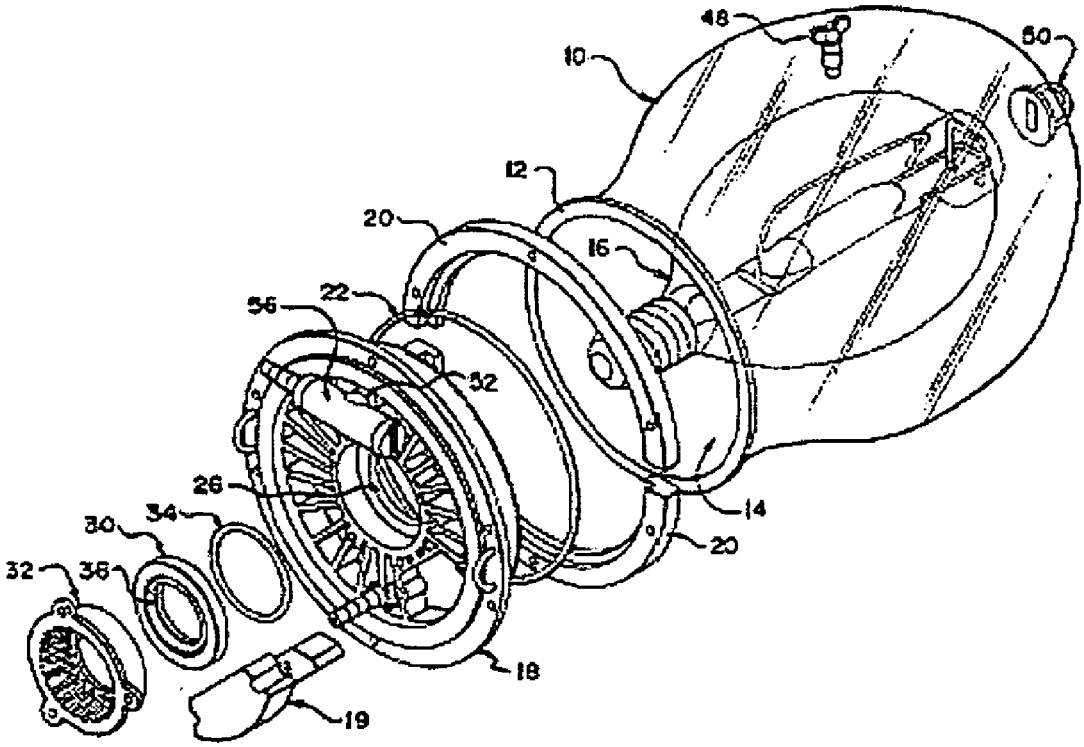
FIG. 1 is a perspective view of a Hydro-coil prior art cooling device.
Figure 2:
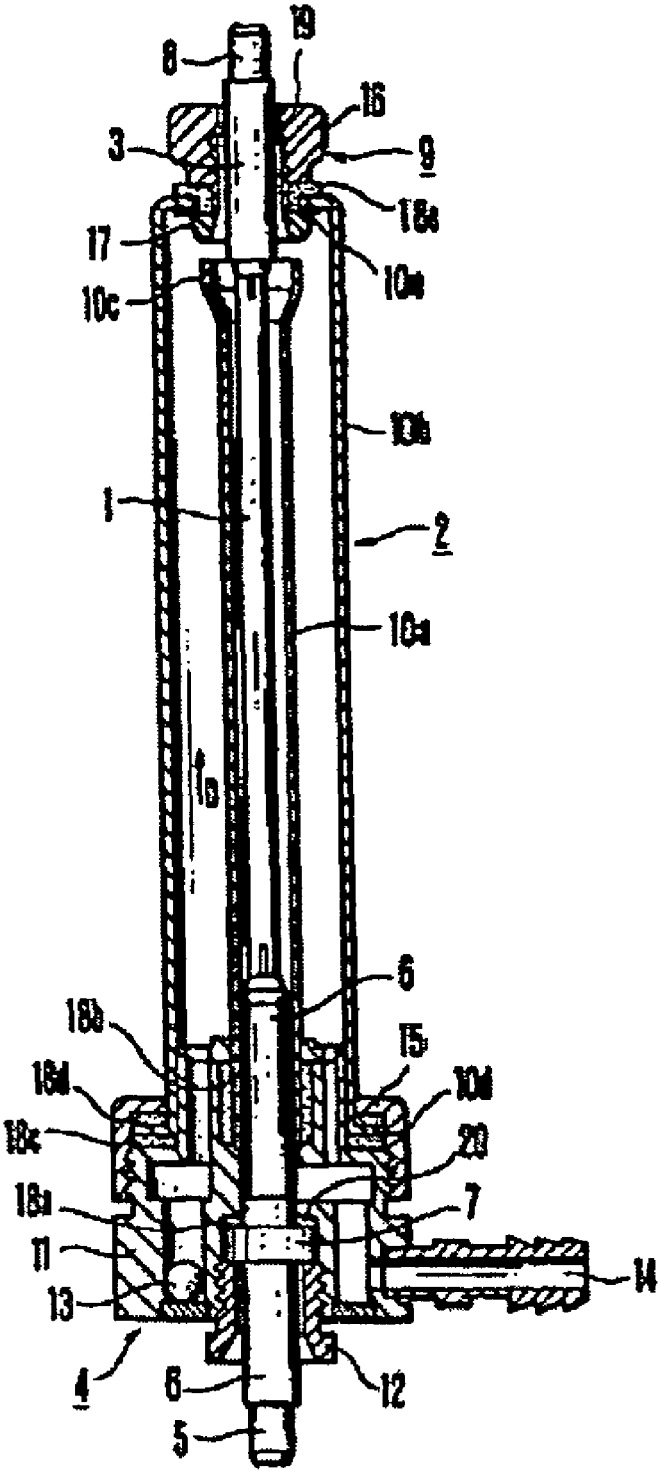
FIG. 2 is a cross section view of the prior art device of U.S. Pat. No. 5,147,130.
Figure 3:
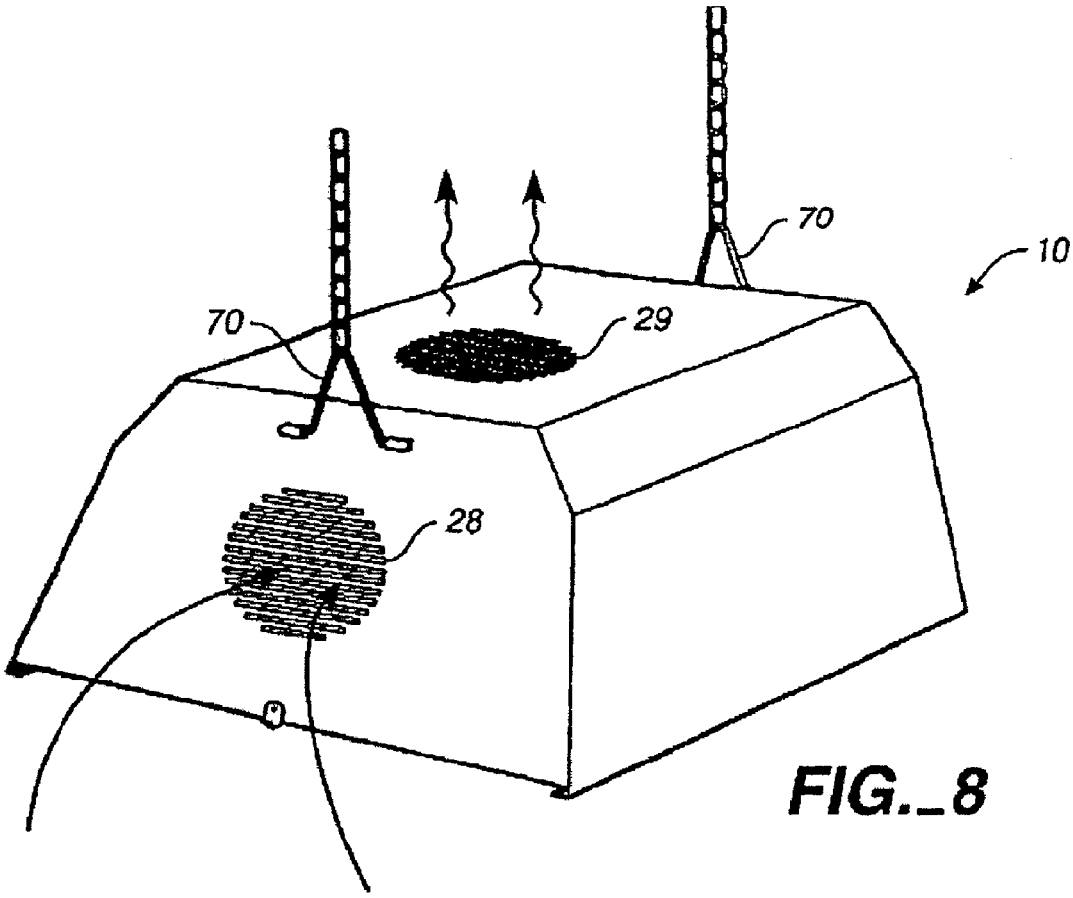
FIG. 3 is a perspective view of the prior art device of U.S. Pat. No. 6,595,662.
Figure 4:
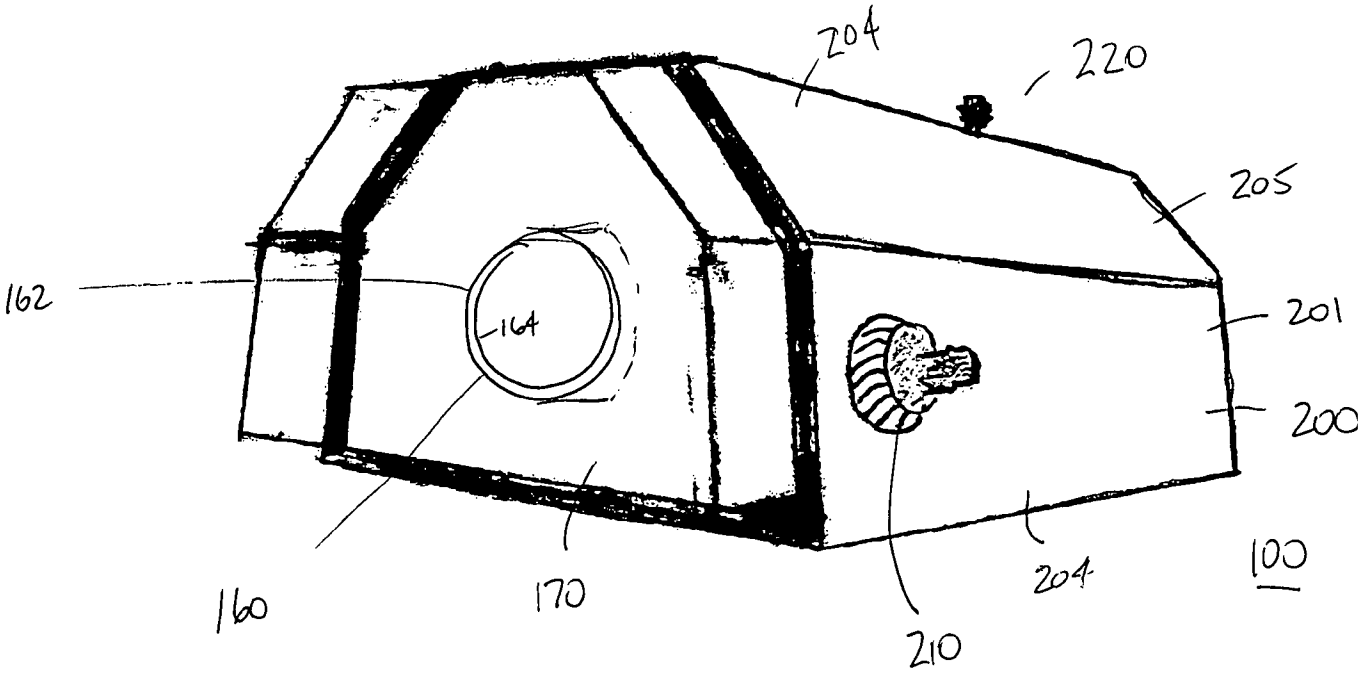
FIG. 4 is a perspective view of an example hood device.
Figure 5B:
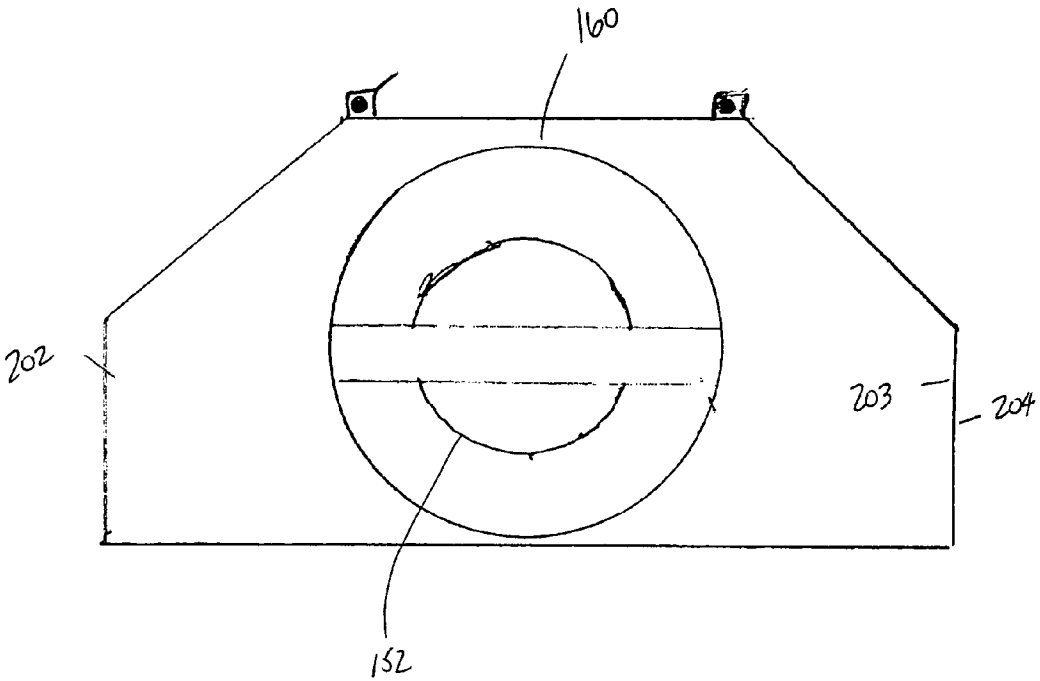
FIG. 5B is a side view of the first end of the hood of FIG. 4.
Figure 5A:
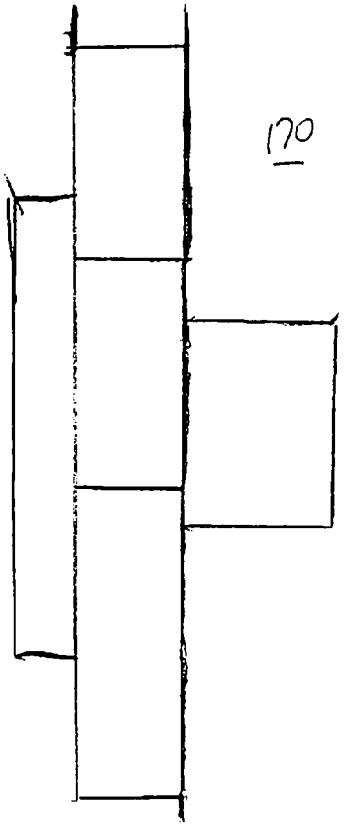
FIG. 5A is a top view of the first end of the hood of FIG. 4.

FIG. 4 is a perspective view of an example hood device 100. FIG. 5A is a top view of the first end of the hood of FIG. 4. FIG. 5B is a side view of the first end of the hood of FIG. 4. The device includes a lamp 150 (not shown) and socket 152, a housing 200 with a lid 205, a first side 201, a second side 202, an inside surface 203, and an outside surface 204; a tube 160 having an outside wall 162, and inside wall 164, a first end 170 and a second end 10 180; a first end seal 172, a second end seal 182; electrical supply connection 154; water supply inlet port 210; water supply exit port 220; and bottom panel 230. The bottom panel includes an outside surface 232 and an inside surface 234. The hood contains a volume of coolant 208 between the outside wall 162 of the tube, the inside surface 202 of the housing 200, and the inside surface 234 of the bottom panel 230. In this example, the lid 205 is comprised of a top portion 206 and a bottom portion 207.

This example hood has many advantages over prior art air cooled devices and over the prior art Water Jacket device.

In this example, the Hydroflector holds about 3 gallons of water, while the Water Jacket device holds about 0.5 20 gallon of fluid. This greater volume of coolant provides better cooling, even with lower water flow or pressure.

The Hydroflector is designed to hold water in case of pump failure, thereby protecting plants from excessive heat from the lights for a longer period of time should the pump fail, and protecting the equipment from rapid temperature change once the pump is restarted.

The Water Jacket typically drains the coolant in case of pump failure, and this loss of coolant can cause a rapid heating of the air around the lights. This heating potentially endangers pants, and increases the likelihood of jacket and bulb breakage once cold water is reintroduced.

In the unlikely event of glass tube breakage in the current invention, the glass is self-contained within the unit, thereby protecting the user from cuts and flying glass. In the water Jacket, there is no protection from broken glass.

The current invention is both watertight and water-resistant. All electrical components are protected from the water in the hood as well as from any greenhouse watering overspray. The greenhouse operator may water plants without concern about the hood.

The current invention can be either air-cooled or water-cooled, or both water and air cooled. The liquid cooling is indirect so that the light bulb is not cooled excessively as is a problem in some prior art devices.

The Hydroflector is a one-piece, no-assembly-required solution, whereas the water jacket is only one component of a two-component system.

The current invention may provide a plastic or metal port connection to coolant hoses so that it is not necessary to clamp hoses onto glass fittings of prior art devices. Prior art devices with glass connections are prone to break at the connection.

The water-cooled embodiment of the current invention permits a customer use twice as many hoods within the same area as an air-cooled system. With the Hydroflector, the customer has the option of putting two light bulbs under one hood, resulting in greater light output, or greater spectrum range. The water jacket, within the same area, supports a single bulb. The water-cooled system allows plants to be much closer to the light source than air-cooled systems, typically as close as 12" in some cases versus 36" for most air-cooled systems.

DETAILED DESCRIPTION OF EMBODIMENT—AIR COOLED HOOD

The Cooling Hood described above can be operated with coolants other than water. In one example, air is used as the coolant, and air is delivered to the inlet port. Warm air exits the hood through the exit port, and is typically directed outside of a greenhouse or other grow area.

DETAILED DESCRIPTION OF EMBODIMENT—WATER COOLED HOOD

Figure 6:
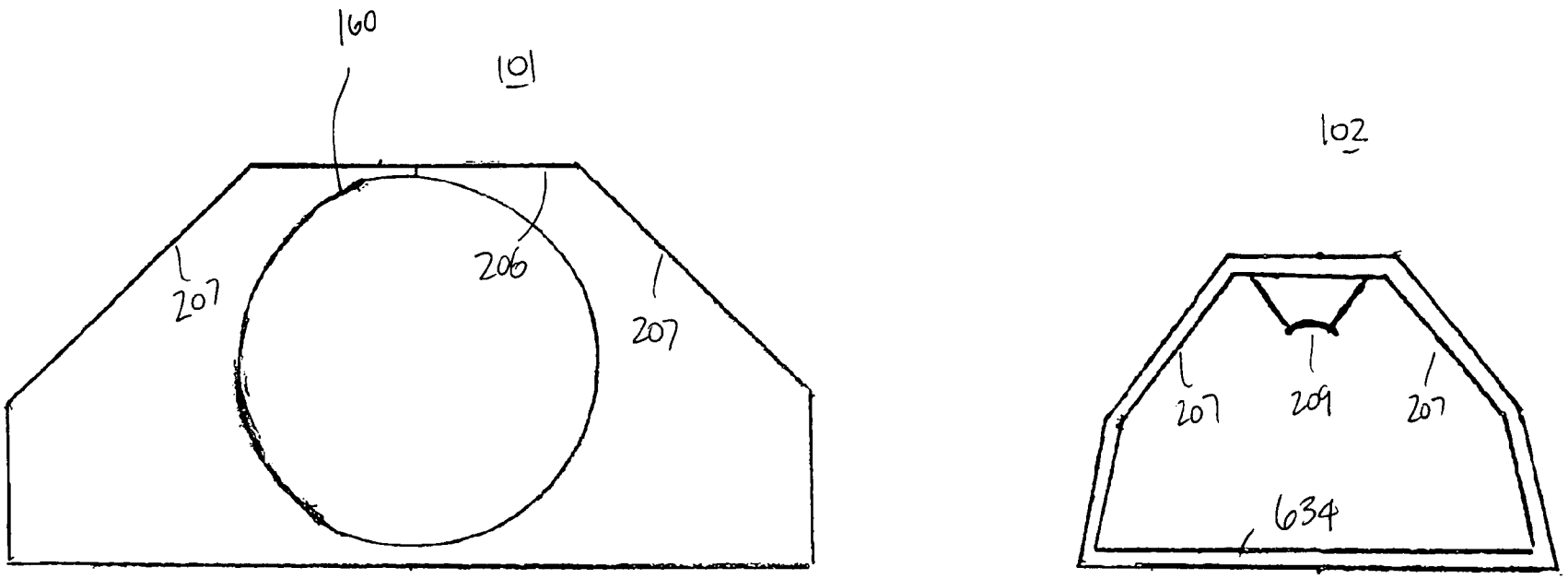
FIG. 6 is a cross section view showing a variety of shapes for the hood housing.

FIG. 6 is a cross section view showing a variety of shapes 101 and 102 for the hood housing. The hood shape may be selected for a desired profile for coolant volume or light reflection. In one example, the profile is selected to provide an efficient reflective surface so that the upper lid portion 206 and lower lid portion 207 may redirect light from the top of the lamp to a plant growing area. The angles and sizes of the lid portion can be selected to provide the desired reflective characteristics. The reflective pattern may be large or small, depending on the plant growth objective. For instance, a commercial operation may desire to spread light, while an individual hobbyist may desire to focus light on a singe rose plant. The angle of the hood lid and sides, and optional insert reflectors 209 typically determine the reflective characteristics of the device.

DETAILED DESCRIPTION OF EMBODIMENT—AIR COOLED HOOD

Figure 7:
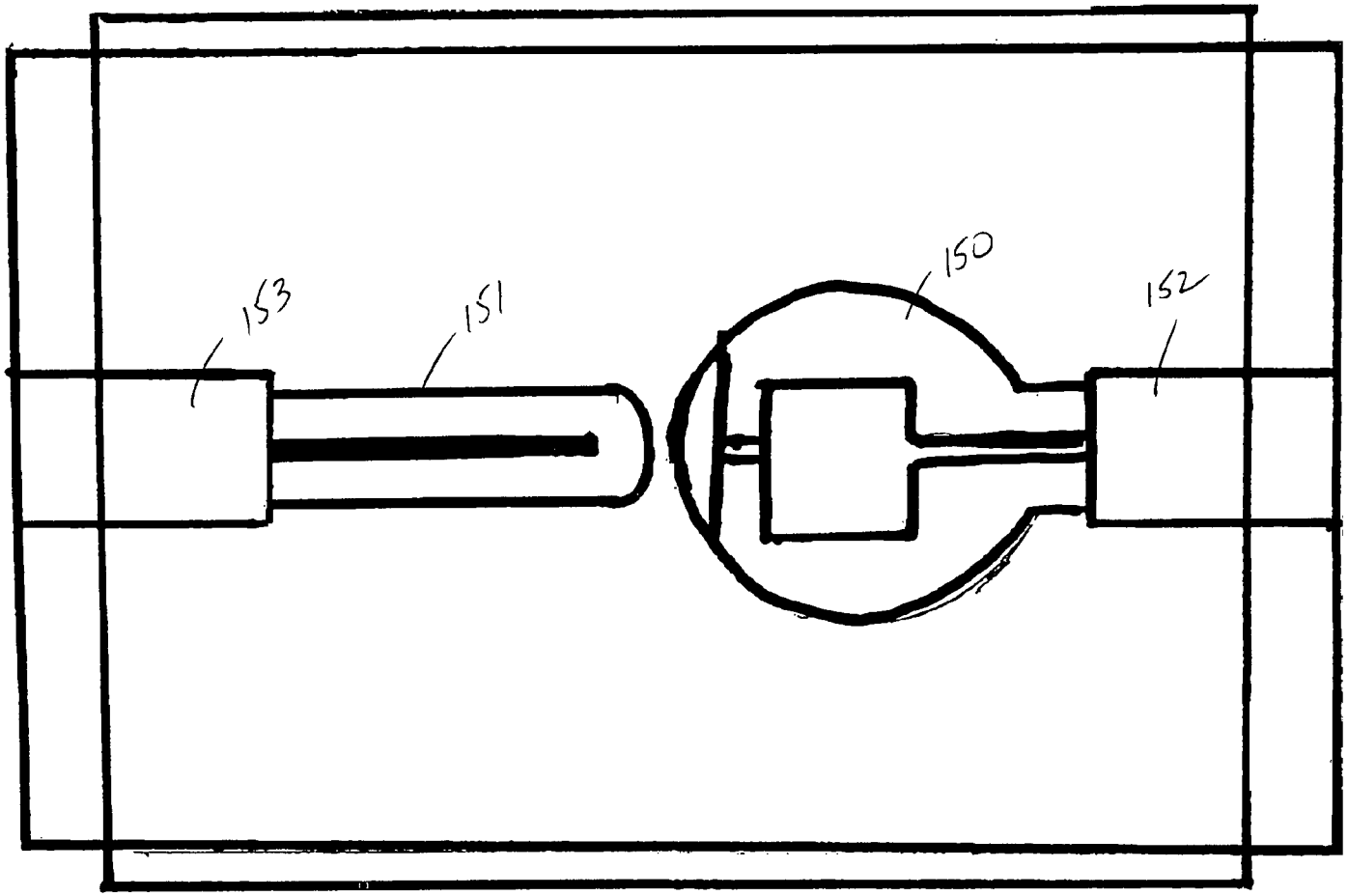
FIG. 7 is a perspective view of an example hood device with two light bulbs.

FIG. 7 is a perspective view of an example hood device with two light bulbs 150 and 151. Bulb 150 is inserted into socket 152, and bulb 151 is inserted into socket 153. In this case, the bulbs may be the same type of lamp or may have different wavelength characteristics. Each bulb is easily installed or replaced such as by removing an end cap or portion of end cap to access the light socket.

DETAILED DESCRIPTION OF EMBODIMENT—DOUBLE CYLINDER COOLANT DEVICE

Figure 8:
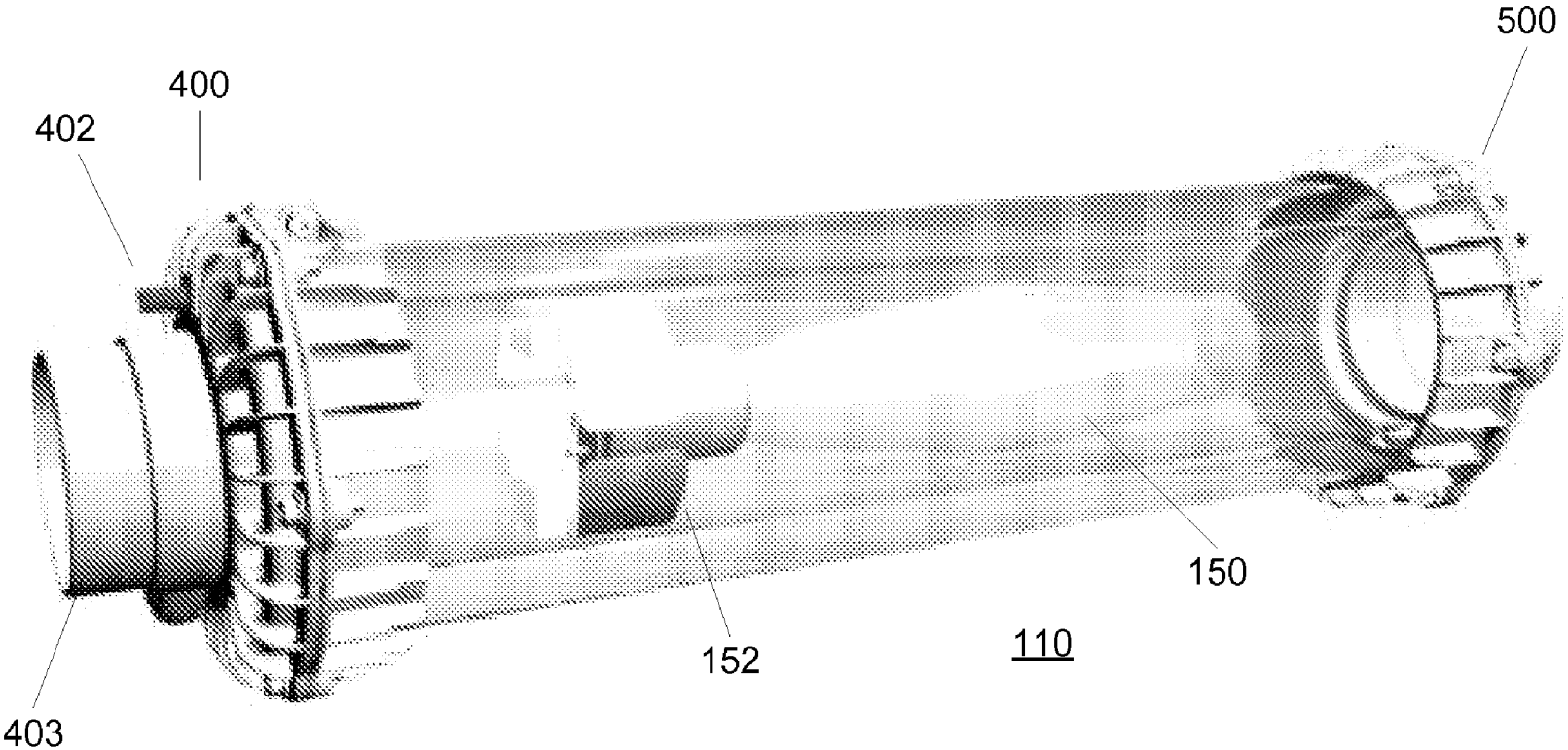
FIG. 8 is a perspective view of a double cylinder coolant device.

FIG. 8 is a perspective view of a double cylinder coolant device 110. In this example, the device includes a lamp 150 in socket 152; an inner tube 160 with an outside wall 162, an inside wall 164, a first end 170, and a second end 180; an outer tube 300 with an outside wall 302, an inside wall 304, a first end 310, and a second end 320; a first end cap 400 with an inlet port 402, an inner tube seal 410 (not shown), and an outer tube seal 420 (not shown); a second end cap 500, with an outlet port 502, an inner tube seal 510 (not shown), and an outer tube seal 520 (not shown). A volume of coolant 207 (not shown) is contained between the inner tube and the outer tube.

The inner tube 160 and the outer tube 300 may be formed by cutting glass tubes to a desired length. As described below, the lengths of the inner and outer tubes may be different.

Figure 9:
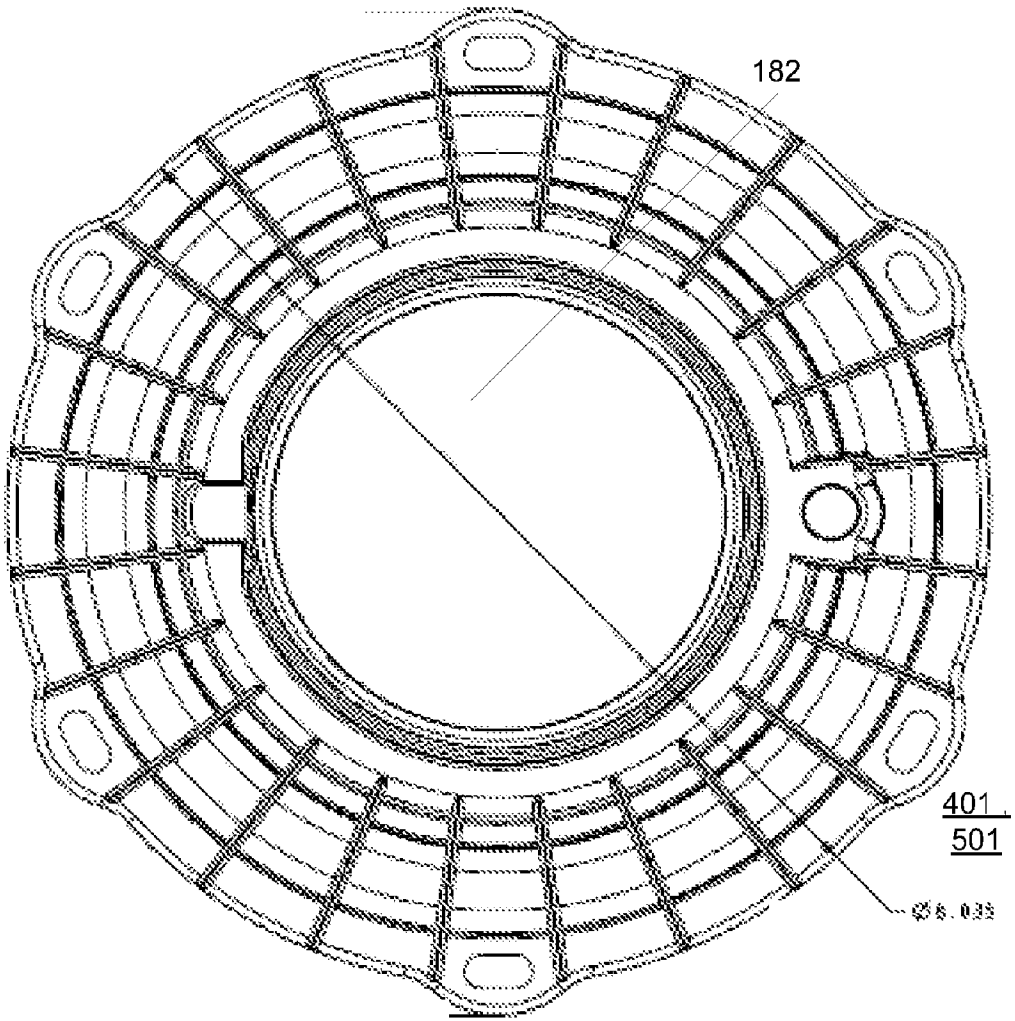
FIG. 9 is a front view of an end cap for the double cylinder coolant device of FIG. 8.

FIG. 9 is a front view of an end cap 401 or 501 for the double cylinder coolant device of FIG. 8. Removing the end cap provides access to socket 152 to replace the light bulb. Return port 502 may include a pressure relief valve. The end cap includes inner tube seal 510, and outer tube seal 520. Each end cap typically includes one or more bracket for hanging the device. The end cap is typically metal, but may be provided in other materials such as a high temperature plastic. In one example, the supply port is positioned on a lower portion of an end cap, and the return port is positioned on a higher portion of the opposite end cap in order to promote coolant circulation around the inner tube. In one example, the end caps have an air duct sleeve extension 403, 503 to permit attachment of an air hose to the end cap. A drain hole may be provided in the end caps to permit any coolant which leaks past the seals to drain from the caps rather than entering the inner tube.

Figure 14:
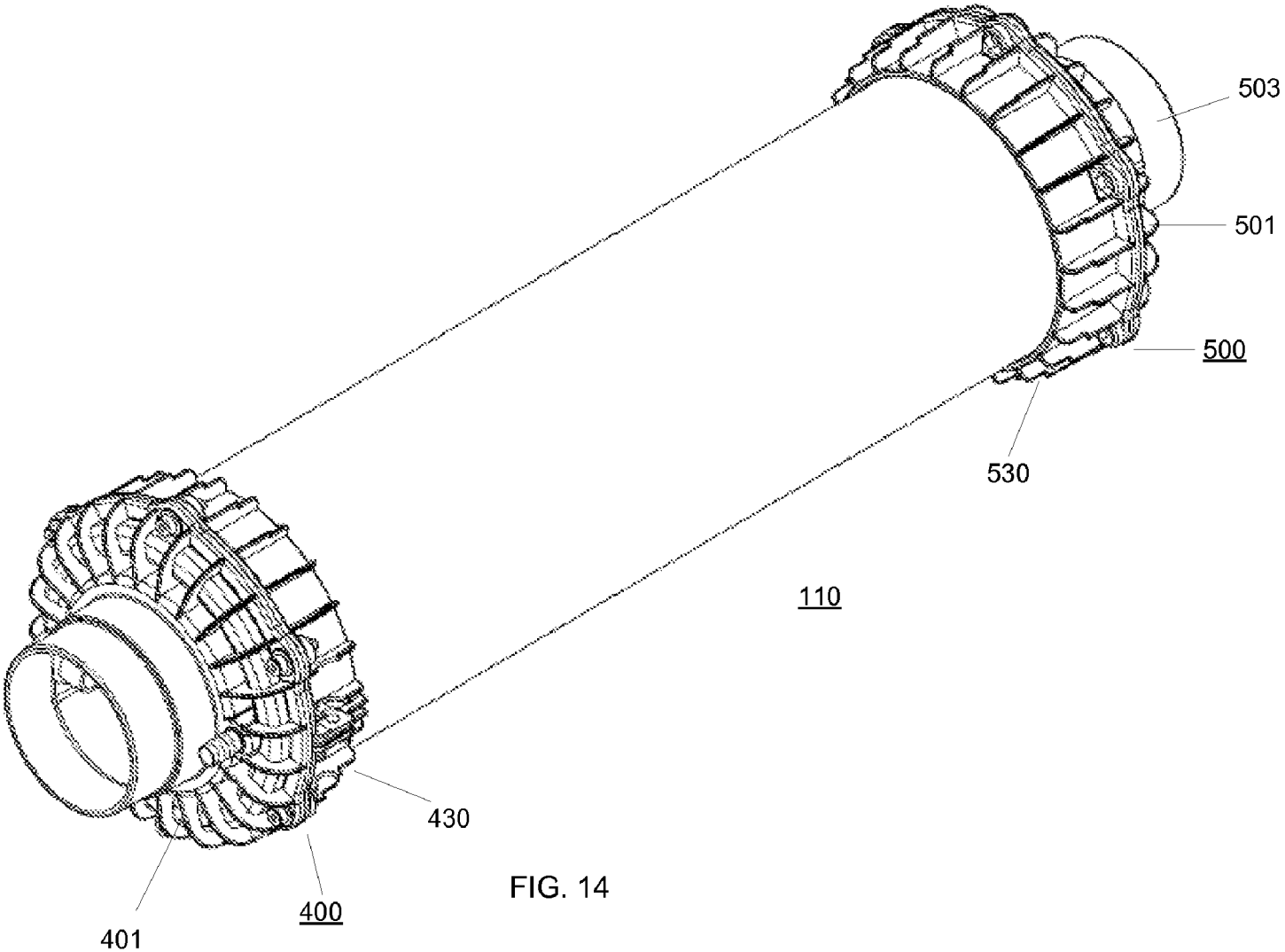
FIG. 14 is a side perspective view of the double cylinder coolant device.

FIG. 14 is side perspective view of a double cylinder coolant device 110 showing a lamp 150 in a socket 152 located in the center of the device. The device includes a first end cap assembly 400 comprising a flange 430 and end element 401, and a second end cap assembly 500 comprising a flange 530 and end element 501.

Figure 15:
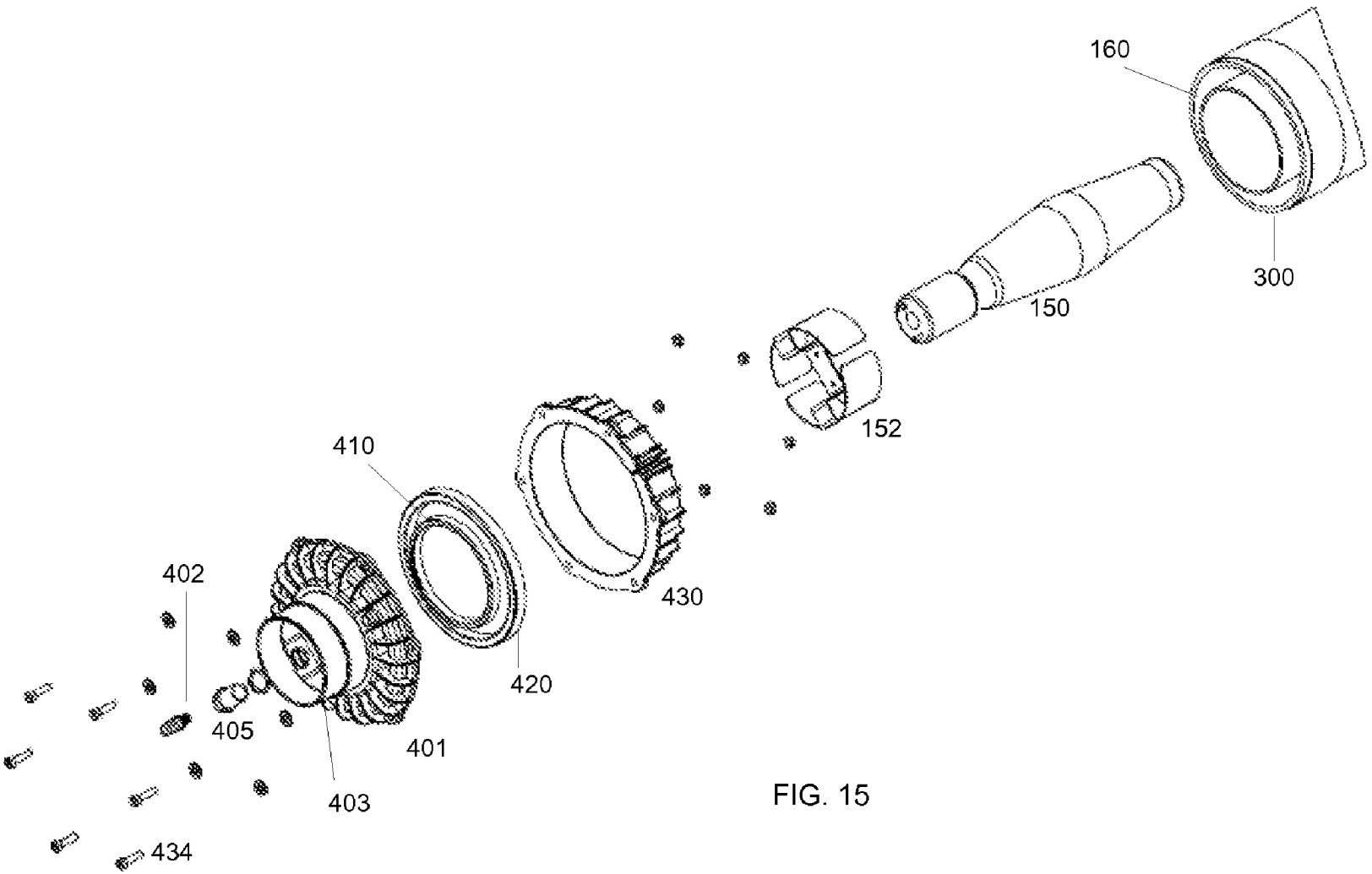
FIG. 15 is an exploded detailed view of the end cap assembly 400 for mounting on a double cylinder coolant device of FIG. 14.

FIG. 15 is an exploded detailed view of the end cap assembly 400 for mounting on a double cylinder coolant device of FIG. 14. In this example, the end cap 400 comprises a molded plastic flange 430 which is attached to the outside of the outer cylinder 300, and an end element 401. The flange may be glued to the outer cylinder, or be mechanically attached such as with a split ring attachment as shown or a two part ring where the two ring hemispheres are bolted together. The mechanical attachment, such as the split ring attachment provides a tolerance to variations in tube diameter which can be expected to be about 0.003 to 0.004 inches (0.007 to 0.010 cm). A rubber liner may be placed between the outer glass tube and the split ring or two part ring in order to provide improved friction and seal to the glass.

The flange is provided with a plurality of threaded inserts 432 or nuts, where the inserts accept end cap mounting bolts 434. The end cap includes a plurality of bolt holes, to accept mounting bolts 434 which are threaded into the threaded inserts 432 of the collar. The end cap typically has a hollow center 182 to permit access to the inside of the inner cylinder, such as to permit coolant air flow, or to accept or access a light bulb. The end cap of FIG. 15 shows an outlet port 402 for coolant flow and a pressure relief valve 405. The outlet port is typically a plastic or metal fitting which is provided as a bulk head fitting, or a glued nipple.

Figure 16:
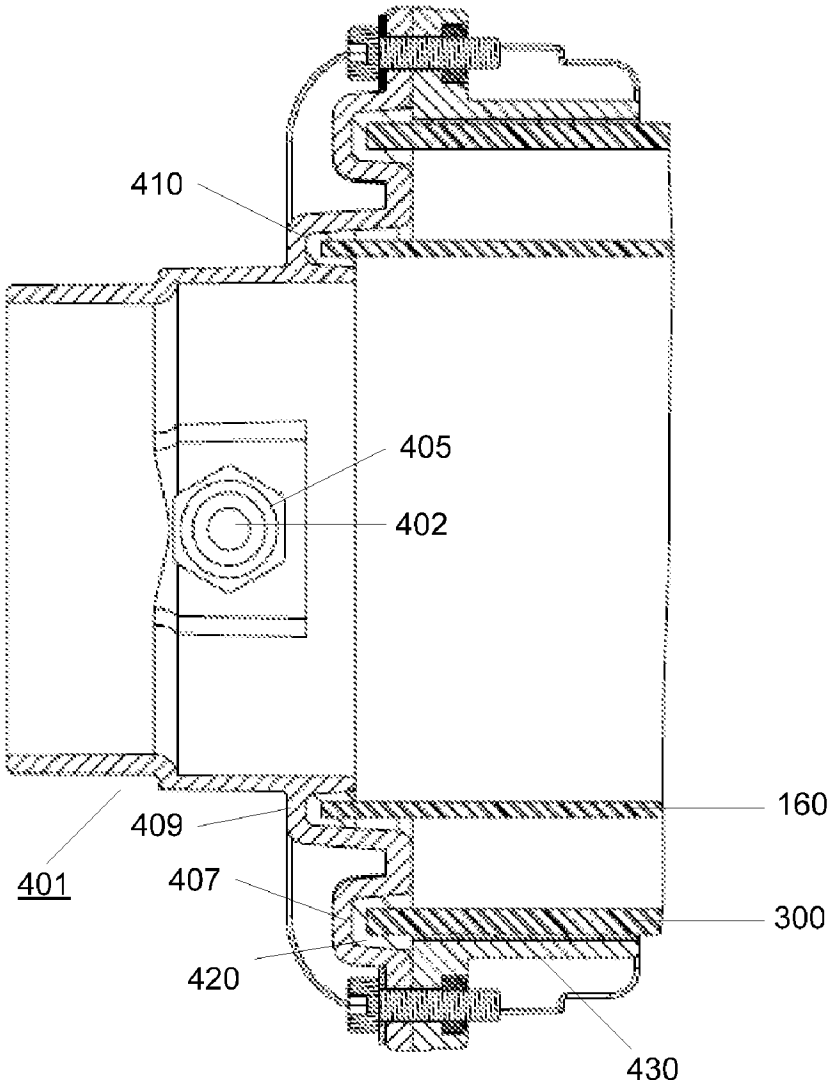
FIG. 16 is a side cross-sectional view of end cap assembly 400.

FIG. 16 is a side cross-sectional view of end cap assembly 400. The end element 401 is bolted to the flange 430 which is affixed to the outer tube 300. The end element 401 includes an outer groove recess 407 for mating with the outer cylinder 300. An outer tube seal 420 is nested in the outer groove 407. The end element 401 includes an inner groove recess 409 for mating with the inner cylinder 160. An inner tube seal 410 is nested in the inner groove 409.

In this example, the inner tube is longer than the outer tube, and the outer tube has a greater wall thickness than the inner tube. In one example, the inner and outer groove recesses are square cut and the inner and outer tube seals are a tapered u-shape. In another example, both the groove recesses and the seals are tapered.

Figure 17:
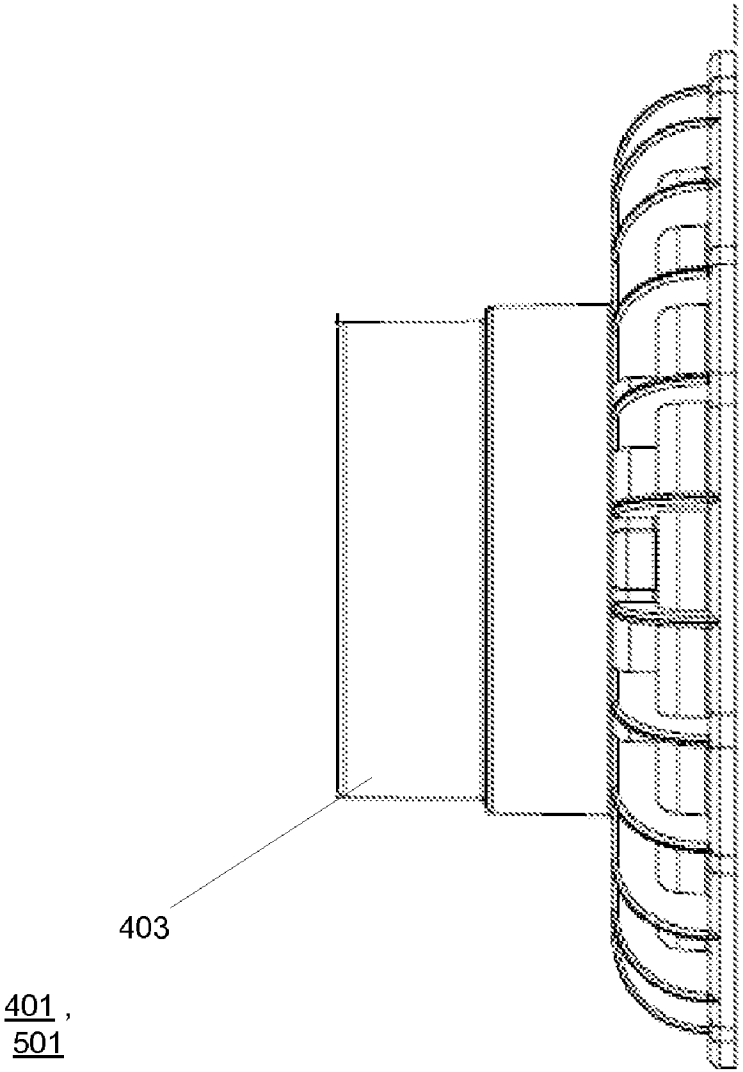
FIG. 17 is a side view of the end element of FIG. 16.

FIG. 17 is a side view of end element 401.

Figure 18B:
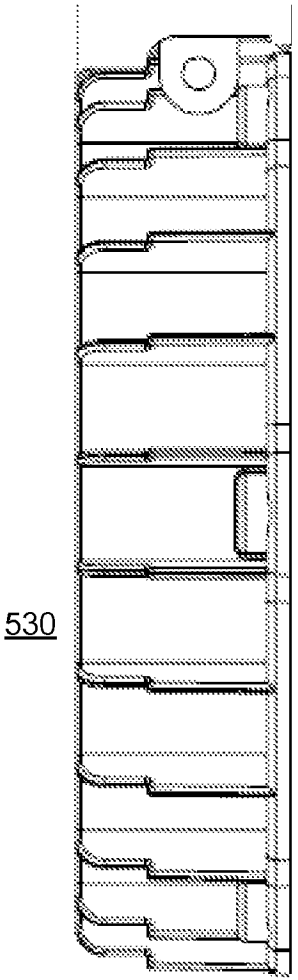
FIG. 18B is an end view of the flange of FIG. 18A.
Figure 18A:
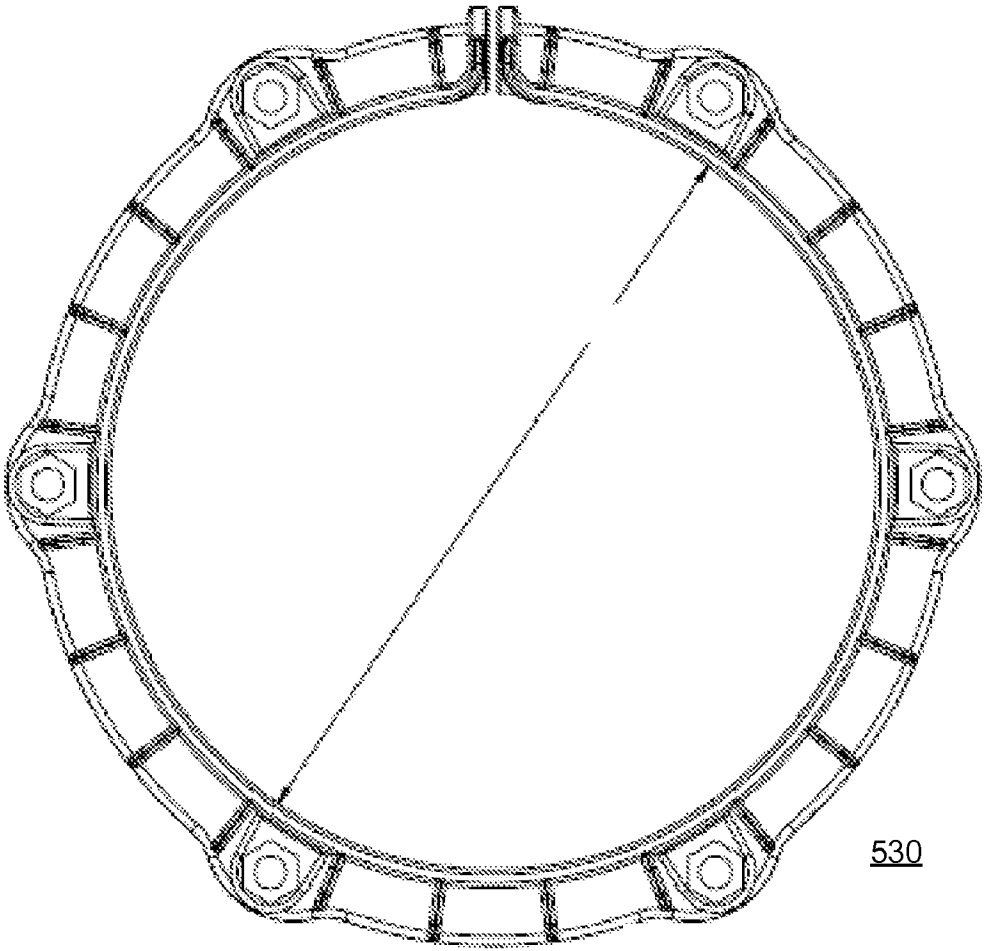
FIG. 18A is an end view of a flange of FIGS. 14-16.

FIG. 18A is an end view of flange 530. FIG. 18B is an end view of flange 530.

Figure 19C:
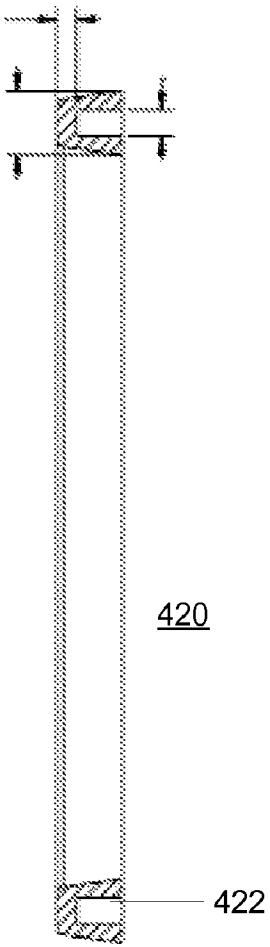
FIG. 19C is a cross sectional view of the outer tube seal of FIG. 19A.
Figure 19B:
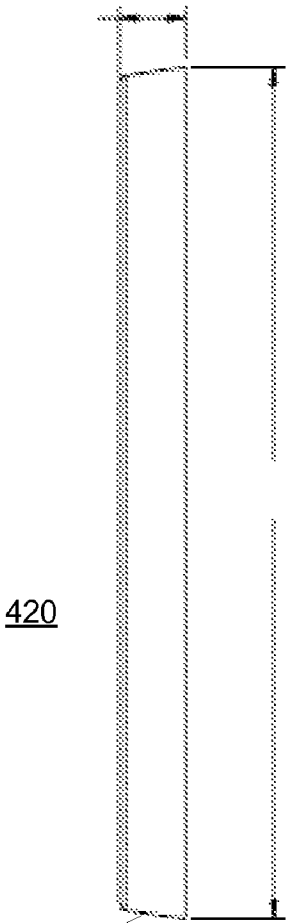
FIG. 19B is a side view of the outer tube seal of FIG. 19A.
Figure 19A:
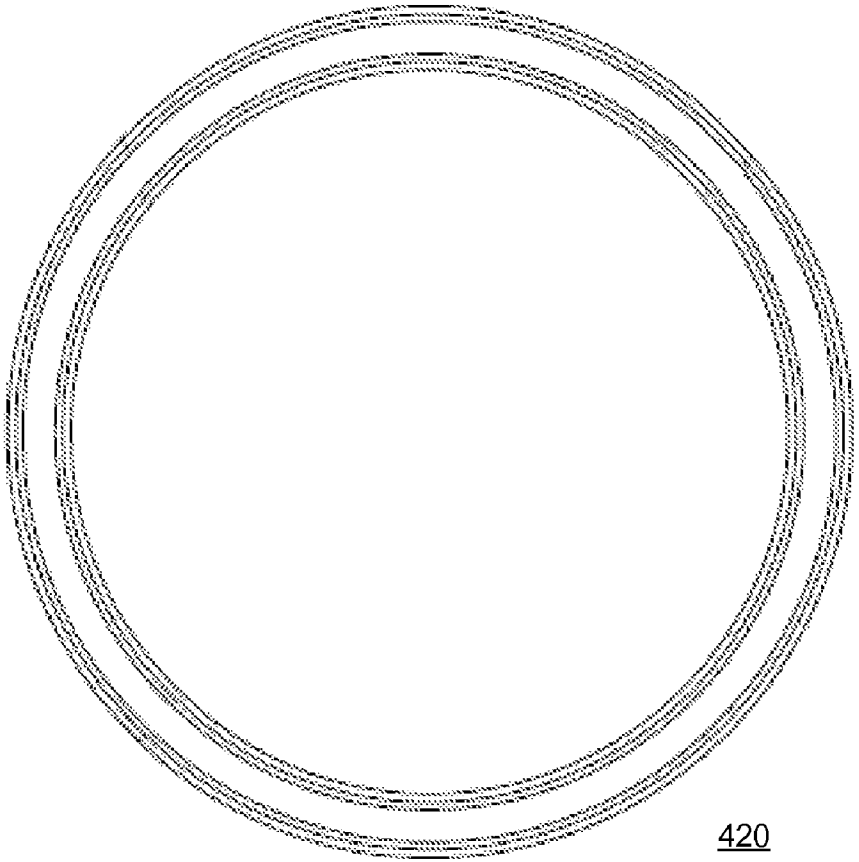
FIG. 19A is an end view of outer tube seal of FIGS. 14-16.

FIG. 19A is an end view of outer tube seal 420. FIG. 19B is a side view of outer tube seal 420 showing tapered 10 edge 421. FIG. 19C is a cross sectional view of outer tube seal 420 showing slot 422 which accepts the outer tube 300.

Figure 20C:
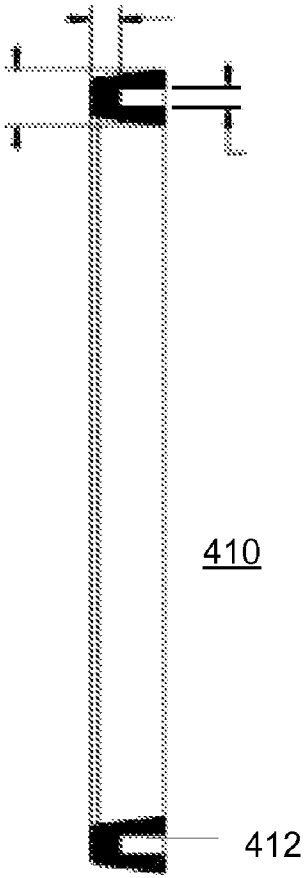
FIG. 20C is a cross sectional view of the inner tube seal of FIG. 20A.
Figure 20B:
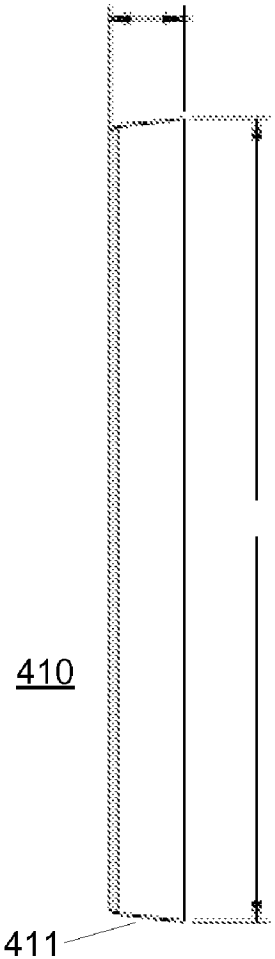
FIG. 20B is a side view of the inner tube seal of FIG. 20A.
Figure 20A:
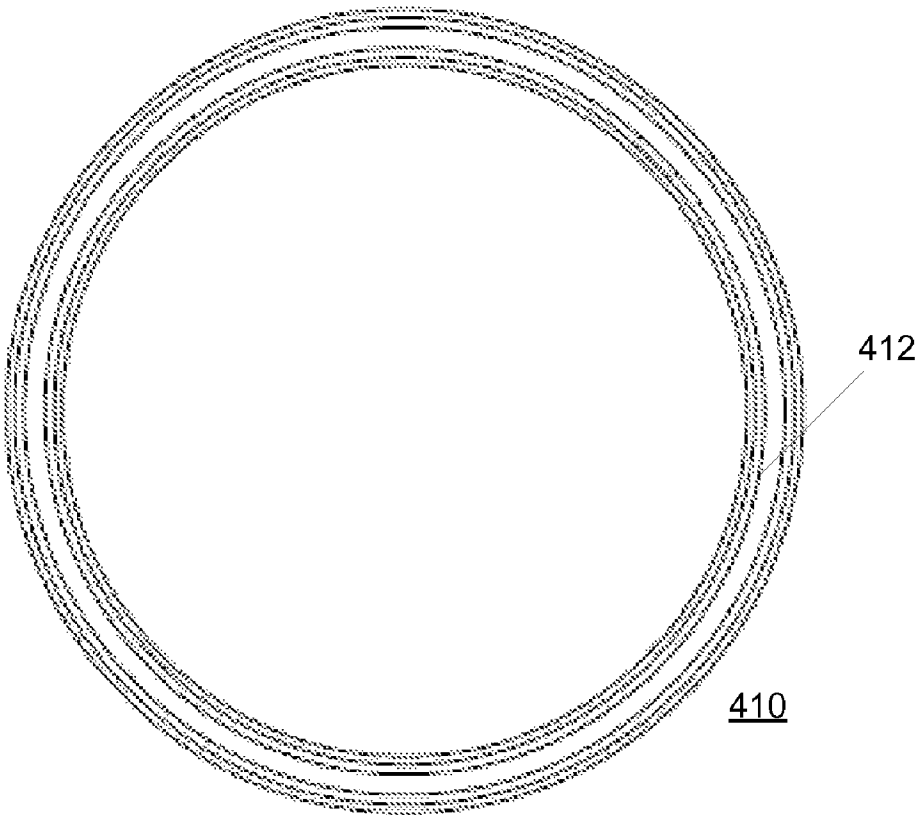
FIG. 20A is an end view of inner tube seal of FIGS. 14-16.

FIG. 20A is an end view of inner tube seal 410. FIG. 20B is a side view of inner tube seal 410 showing tapered edge 411. FIG. 20C is a cross sectional view of inner tube seal 410 showing slot 412 which accepts the inner tube 15 160.

Lamp Holder

In one example, the lamp holder may be aluminum sheet metal so that it is held in place against the inside of the inner tube by a spring action against the wall of the tube.

Figure 21:
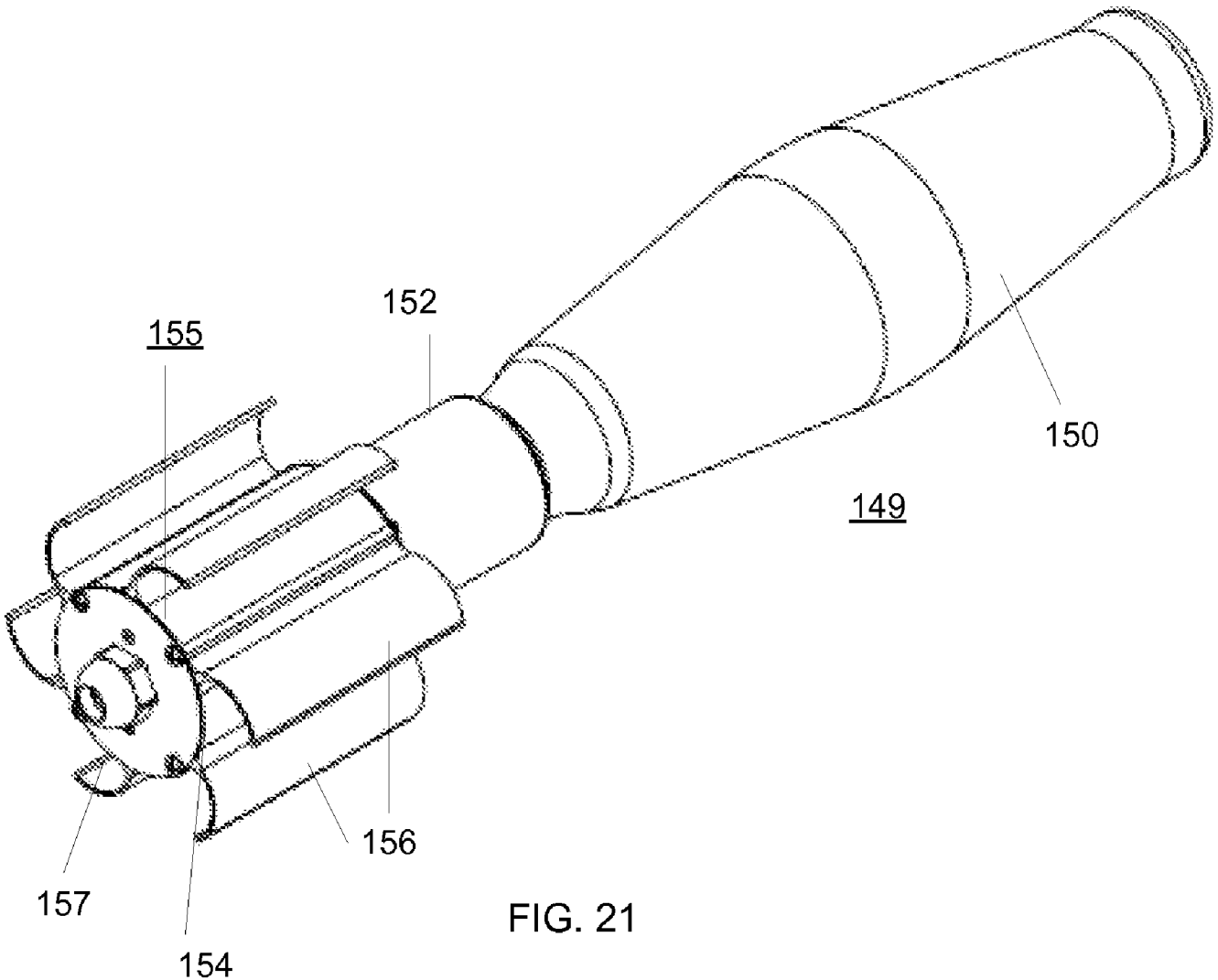
FIG. 21 is perspective view of a lamp holder and bulb assembly.
Figure 22:
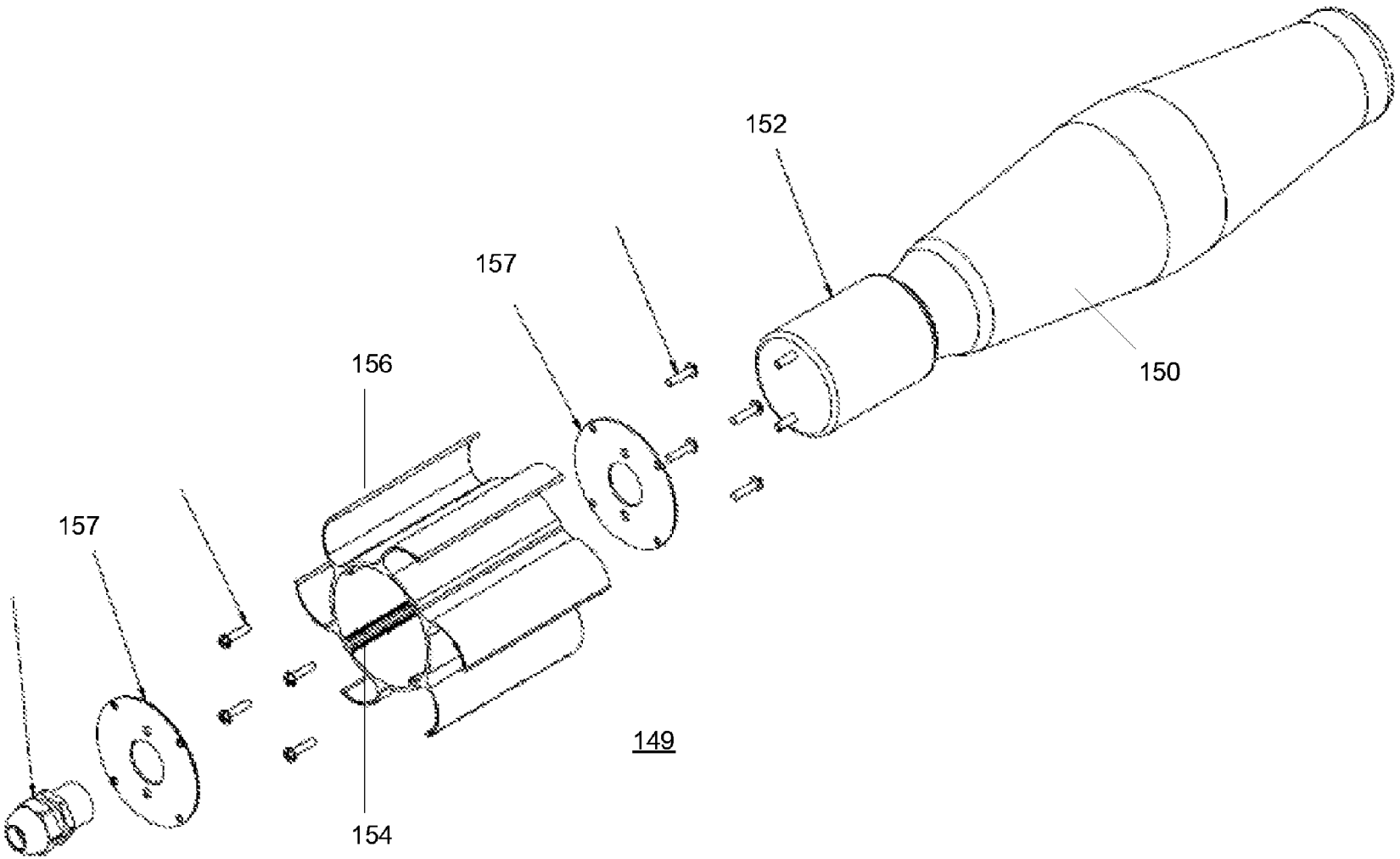
FIG. 22 is an exploded perspective view of the lamp holder and bulb assembly of FIG. 21.

FIG. 21 is a perspective view and FIG. 22 is an exploded perspective view of a lamp assembly 149 comprising a bulb 150, a socket 152, enclosed electric box 154 with curved fins 156 and cover plates 157. In this example, there are six curved fins 156 which may is adjustable to the slight variations in diameter of glass tubes, and may be compressed slightly to form a friction fit in the inner tube. The electric box and fins are preferably made of a thermally conductive aluminum so that heat can be conducted from the socket to the inner tube. The enclosed junction box is an improvement over prior art.

Two or more light assemblies may be positioned in a cooling device.

Cleaning

The lamp holder and lamp may be removed from the device, and the end elements may be unbolted from the flanges so that the device may be disassembled for cleaning. Once the bolts 434 are removed from the first end cap assembly 400, the end element 401 may be separated from the flange 430; and the end element may be pulled away from the inner and outer tube. The inner and outer tube seals may be removed from the inner and outer tube. The end cap assembly 500 may be disassembled with the same process, so that the inner and outer tubes can be separated. The separated tubes may then be cleaned and reassembled.

Example

In one example, the inner tube has a length of 26.625 inches (67.63 cm), an outer diameter of 4.724 inches (12.00 cm), and a wall thickness of 0.125 inches (0.3175 cm). The inner seal has an outer diameter of 4.947 (12.57 cm) inches and a thickness of 0.466 (1.18 cm) inches. The inner seal has a slot with a width of 0.125 inches (0.3175 cm) and a depth of 0.281 (0.713 cm) inches. The inner seal is preferably made of a compliant polymer or copolymer 5 or copolymer such as EPDM rubber and/or neoprene.

The outer tube has a length of 25.875 (65.72 cm) inches, an outer diameter of 6.65 inches (16.89 cm), and a wall thickness of 0.210 inches (0.533 cm). The outer seal has an outer diameter of 6.963 inches (17.69 cm) and a thickness of 0.54 inches (1.37 cm). The outer seal has a slot with a width of 0.210 inches (0.533 cm) and a depth of 0.375 inches (0.953 cm). The outer seal is preferably made of a compliant polymer or copolymer such as EPDM rubber and/or neoprene.

The flanges 430 and 530 have an inside diameter of 6.714 inches (17.05 cm), and a width of 1.875 inches (4.76 cm). The end elements 401 and 501 have a diameter of 8.035 inches (20.41 cm) with enlargements to a diameter of 8.547 inches (21.71 cm) around the bolt holes. Six bolts are used to assemble an end element to a flange. The end elements have extension of outer diameter 4.001 inches (10.16 cm). The extensions are hollow to permit access to the lamp and to permit airflow through the inner tube.

Example

In this example, the end caps include inner and outer tube seals and seal grooves or recesses. The end caps are held in place against the glass tubes by tension between the end caps. One form of tension is provided by two or more connecting rods placed between the end caps. The connecting rods may be threaded on one end with an enlarged hook or head on the other end; or the rods may be threaded on both ends and secured with washers and nuts. Another form of tension is two or more elastic chords between the end caps.

Example

In this example, the outer tube has an outwardly extending lip on each end of the tube. The end caps also have an outwardly extending lip. At each end of the outer tube, a connector is used to mate the tube lip with the cap lip. The connector may be a threaded connector, a split ring connector, or a two-part connector.

Example

In this example, a double cylinder device is placed in a reflective hood in order to direct the light downward to a desired area. In other examples, a reflector may be placed over a portion of the outer tube, placed onto a portion of the outer tube, or placed inside a portion of the outer tube.

Many alterations and modifications of these example devices will be apparent to those skilled in the art, and the scope of the invention is to be construed in accordance with the claims.

DETAILED DESCRIPTION OF EMBODIMENT—WATER OR AIR COOLED HOOD

Another embodiment of the current invention is the Hydroflector™ hood. This embodiment provides a lighter weight hood device which has many of the advantages described above. In this example, the hood device holds approximately 1 gallon of water coolant, or it may be cooled by air flow.

Figure 10:
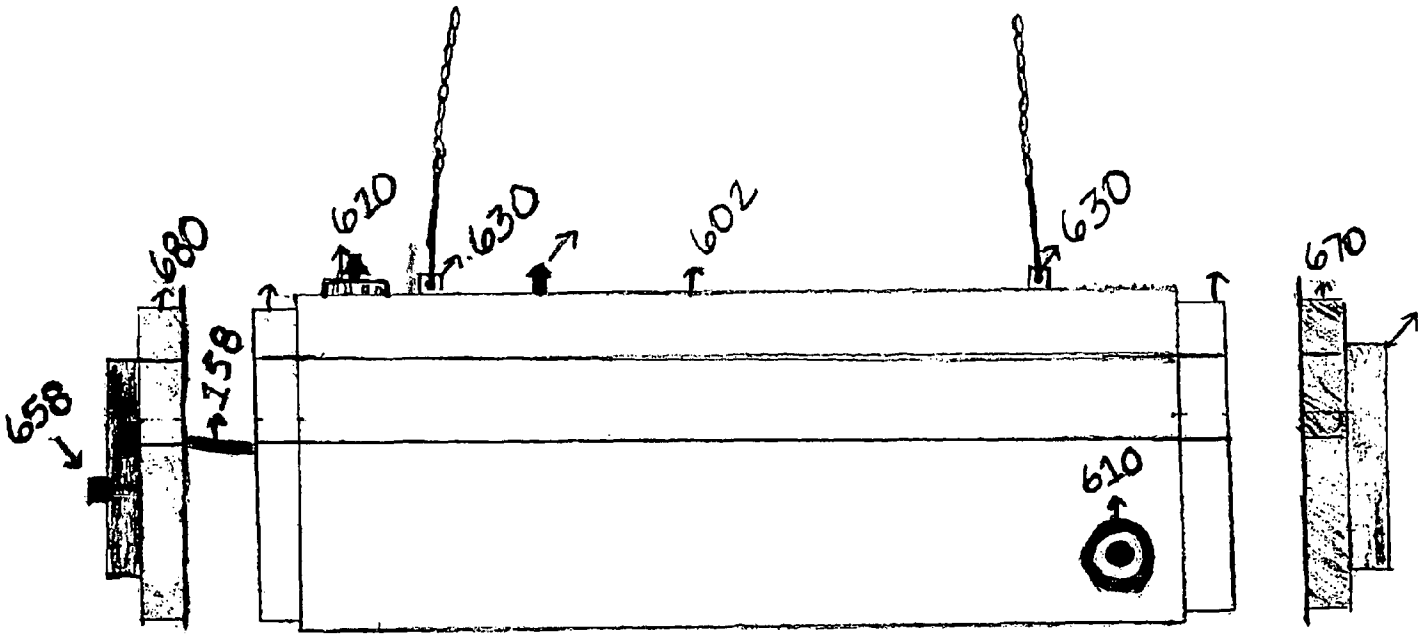
FIG. 10 is a side view of a hood device.
Figure 11:
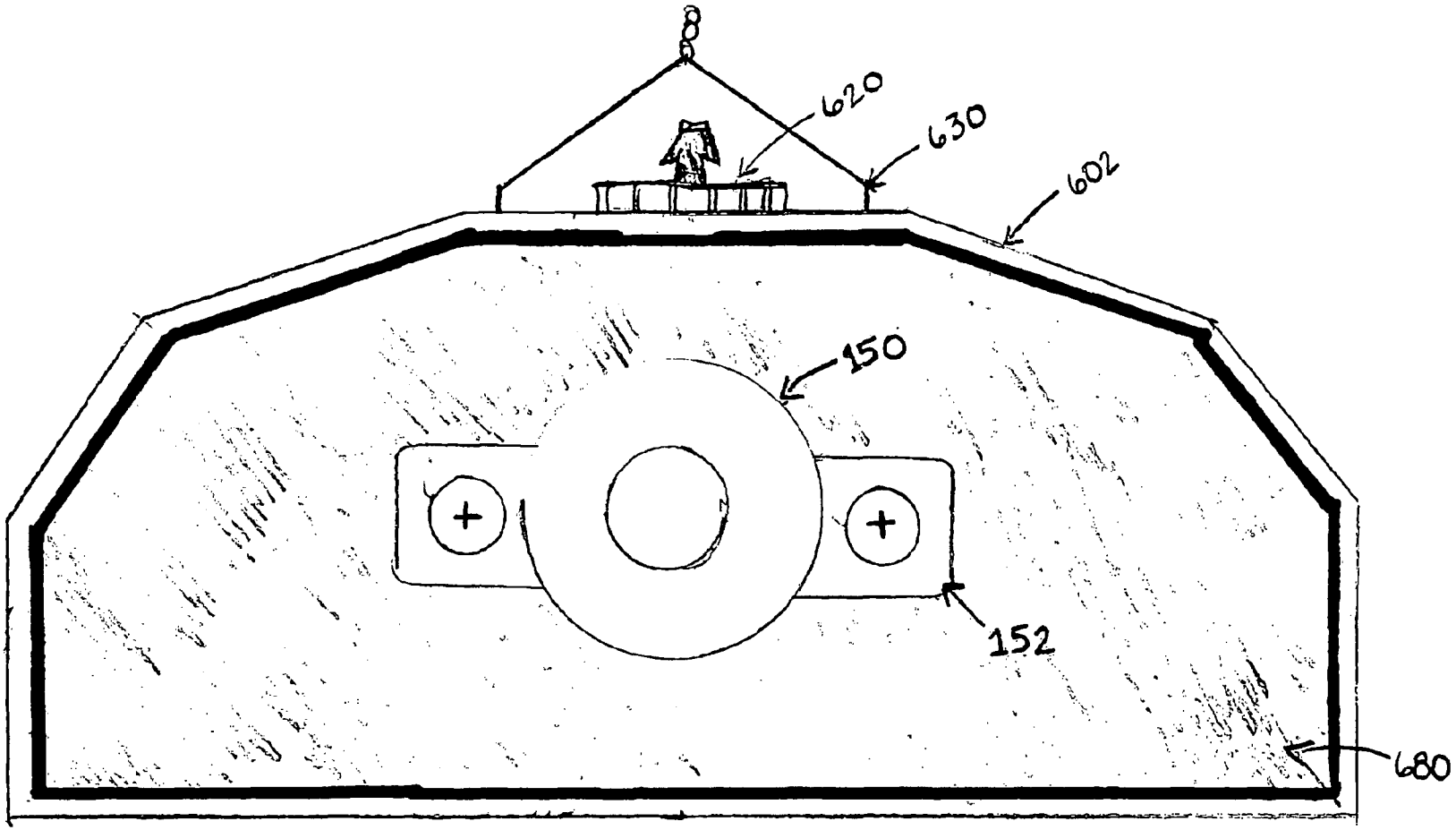
FIG. 11 is a cross section view of the hood device of FIG. 10.
Figure 12:
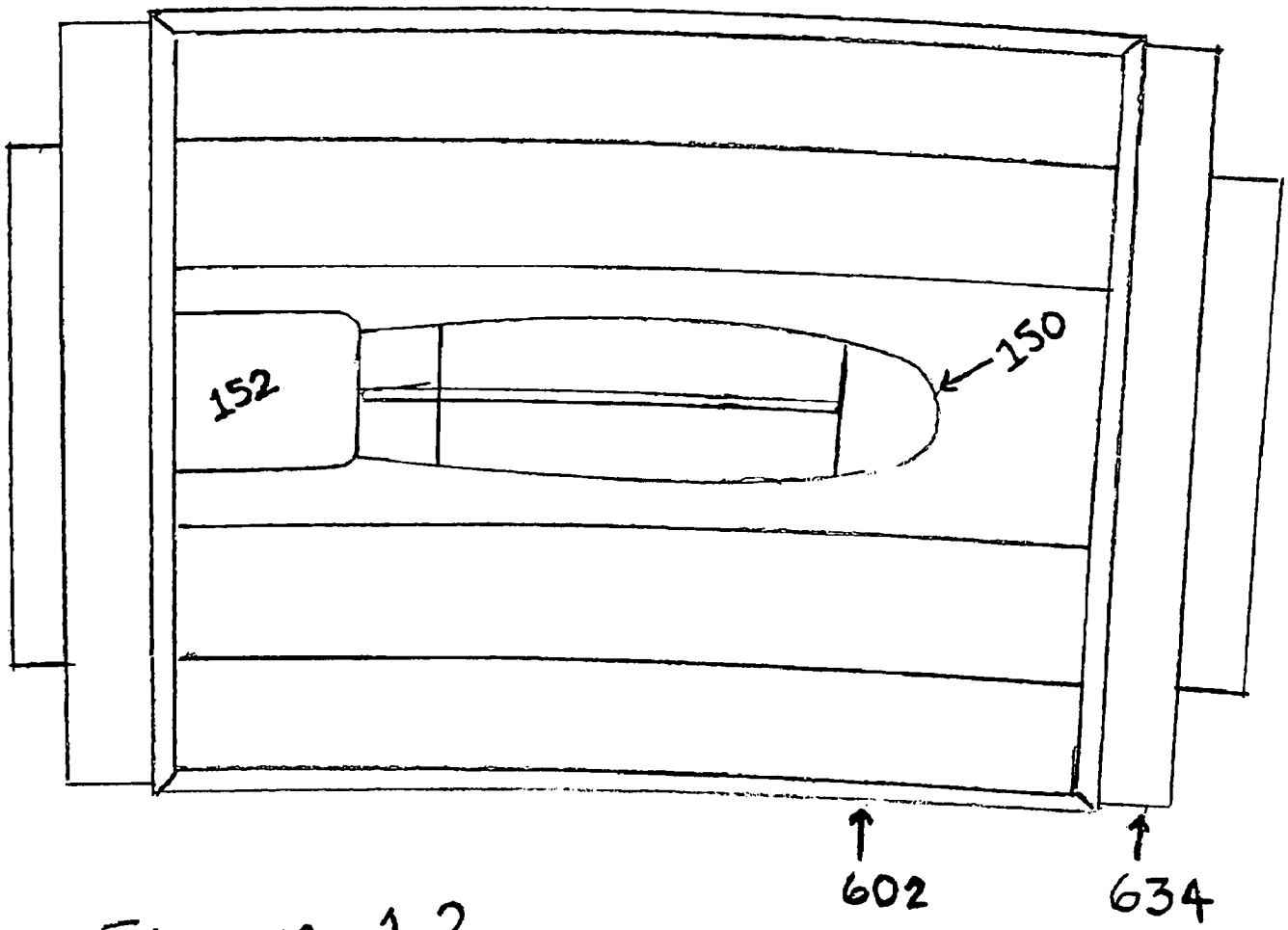
FIG. 12 is a bottom view of the hood device of FIG. 10.

FIG. 10 is a side view of the hood device; FIG. 11 is a cross section view of the hood device; and FIG. 12 is a bottom view of the hood device. The hood 600 comprises a hood body 602 which includes chain support hangers 630. A first end cap 680 includes a light power cord watertight connection 658. A light power cord 158 is provided through the watertight connection to a light socket and bracket 152 for high intensity bulb 150. A second end cap 670 is provided on the other end of the tube device. During liquid cooling, these end caps are sealed against the housing. A coolant flow is provided through water supply port 610 and water return port 620. This coolant flow is typically a recirculating water system which may include a radiator or heat exchanger to remove heat to an area away from the plants. A pressure relief valve 680 may be provided in order to vent a high pressure before the pressure can break or cause leakage to the hood.

The hood may also be air cooled by removing the end caps. End caps 6 inch hole for air cooling. Insulation is provided in the end caps.

To use the device as an air cooled hood, end caps can be removed from the inner tube, which is typically 6 inches in diameter. A first duct is connected to one end of the tube, and to a fan. The second end of the tube may be left open 20 to vent air into a room such as a greenhouse, or a second duct may be attached to direct the exit air out of the room. It is possible to operate the unit as both an air cooled and water cooled device at the same time.

The bottom of the hood is a glass insert 634. The hood provides improved maintenance access. Dirt may be removed from the inner housing and outer housing, to improve optical transmission.

DETAILED DESCRIPTION OF EMBODIMENT—CONTROLS

Figure 13:
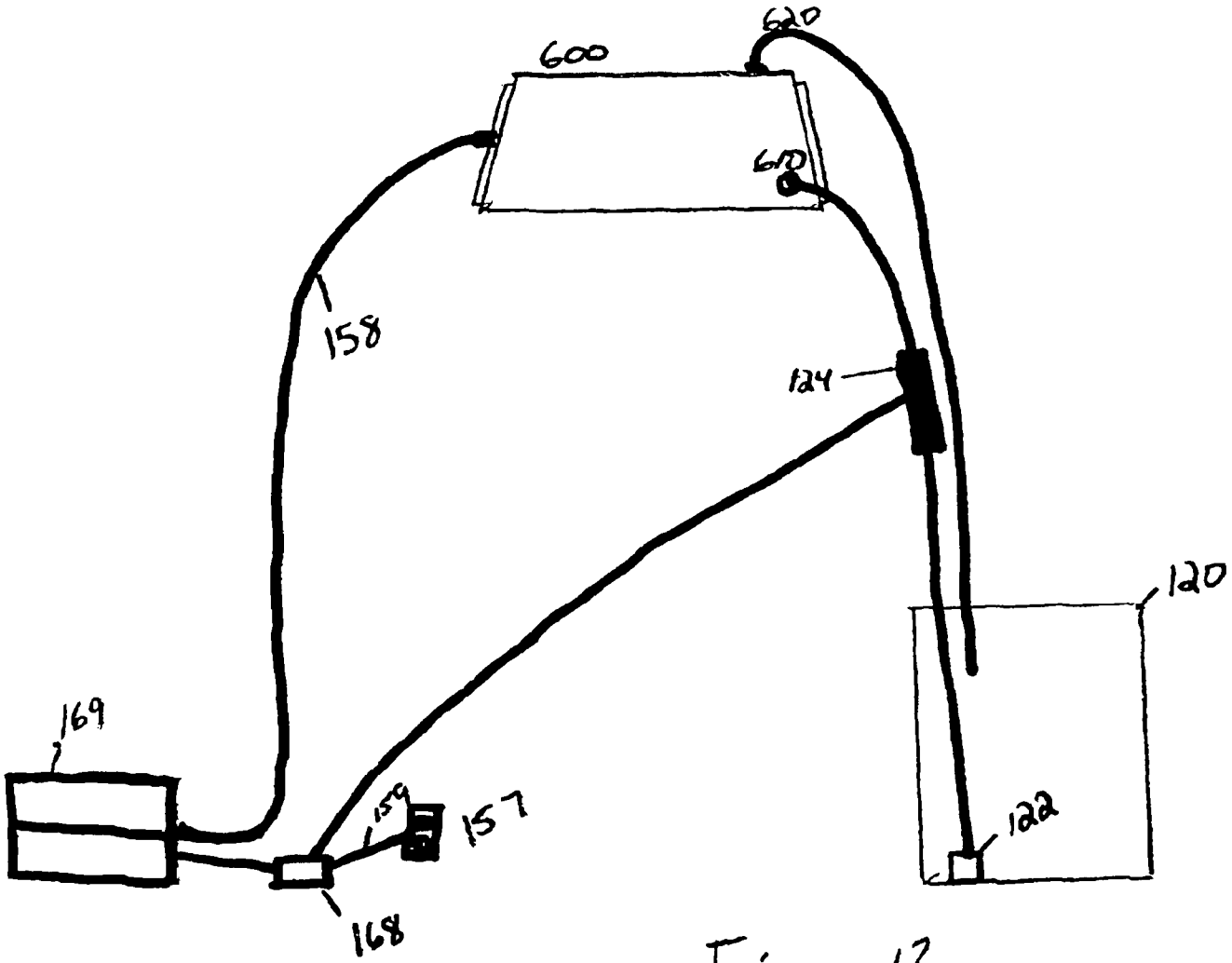
FIG. 13 is a schematic showing fluid and electrical connections to a hood and coolant recirculation system.

FIG. 13 is a schematic showing fluid and electrical connections to a hood and coolant recirculation system. In this example, the hood 600 is supplied by a water coolant through inlet port 610. Coolant exits the hood through return port 620 and flows back to a reservoir 120 with pump 122. An optional heat exchange device may be provided in this loop. A flow sensor 124 is provided in the coolant loop. A cord 159 is plugged into a power receptacle 157 and runs to a control unit 168 and then to ballast 169 and to the hood light socket. The flow sensor sends a signal to the control unit so that if coolant flow is interrupted, the control unit cuts off power to the hood.

DETAILED DESCRIPTION OF EMBODIMENT—LIGHT COOLANT HOOD FOR AQUARIUM

In this embodiment, a double cylinder cooling device such as described above may be used to cool one or more aquarium lights. In one example, an aquarium is provided in a cabinet which includes an upper aquarium housing, and a lower aquarium housing. The aquarium light or lights are placed in a double cylinder cooling device above the aquarium. A coolant recirculation unit is provided in the lower housing. The coolant recirculation unit may also include a heat exchanger to remove heat from the coolant.

What is claimed is:

1. A light bulb cooling device comprising:

an outer tube comprising a first end, a second end, and a transparent lower portion;

an inner tube comprising
a first end, and
a second end;
a hollow first end cap comprising
a coolant fluid supply inlet port, and
an air duct sleeve,
such that the first end cap provides a seal between the first end of the inner tube and the first end of the outer tube;
a hollow second end cap comprising
a coolant fluid supply exit port, and
an air duct sleeve,
such that the second end cap provides a seal between the second end of the inner tube and the second end of the outer tube, so that an annular volume of coolant may be maintained between the inner tube, the outer tube, the first end cap, and the second end cap; and
at least one light bulb assembly positioned within the inner tube, such that at least a portion of the inner tube in proximity to the bulb is transparent.

2. The light bulb cooling device of claim 1 wherein
the first end cap further comprises
an outer tube seal recess,
an outer tube seal,
an inner tube recess, and
an inner tube seal.

3. The light bulb cooling device of claim 2 wherein
the outer tube seal recess has a square cut u-shape cross section; and
the inner tube seal recess has a square cut u-shape cross section.

4. The light bulb cooling device of claim 3 wherein
the outer tube seal has a u-shape cross section; and
the inner tube seal has a u-shape cross section.

5. The light bulb cooling device of claim 3 wherein
the outer tube seal has a tapered u-shape cross section; and
the inner tube seal has a tapered u-shape cross section.

6. The light bulb cooling device of claim 3 wherein
the outer tube seal recess has a tapered u-shape cross section; and
the inner tube seal recess has a tapered u-shape cross section.

7. The light bulb cooling device of claim 6 wherein
the outer tube seal has a u-shape cross section; and
the inner tube seal has a u-shape cross section.

8. The light bulb cooling device of claim 6 wherein
the outer tube seal has a tapered u-shape cross section; and
the inner tube seal has a tapered u-shape cross section.

9. The light bulb cooling device of claim 1 wherein
the outer tube is longer than the inner tube.

10. The light bulb cooling device of claim 1 wherein
a first flange is attached to the outer tube in proximity to the first end of the outer tube;
a second flange is attached to the outer tube in proximity to the second end of the outer tube;
the first end cap is attached to the first flange; and
the second end cap is attached to the second flange.

11. The light bulb cooling device of claim 10 wherein
the first flange is a split ring.

12. The light bulb cooling device of claim 10 wherein
the first flange is a two-part ring.

13. The light bulb cooling device of claim 10 wherein
the first flange is adhesively attached to the outer tube.

14. The light bulb cooling device of claim 10 wherein
the first end cap is bolted to the first flange.

15. The light bulb cooling device of claim 1 wherein
the first end of the outer tube has an outwardly extending lip;
the first end cap has an outwardly extending lip;
a first connector engages the outwardly extending lips of the first end of the outer tube and the first end cap;
the second end of the outer tube has an outwardly extending lip;
the second end cap has an outwardly extending lip; and
a second connector engages the outwardly extending lips of the second end of the outer tube and the second end cap.

16. The light bulb cooling device of claim 15 wherein
the first connector is threaded.

17. The light bulb cooling device of claim 15 wherein
the first connector is a split ring.

18. The light bulb cooling device of claim 15 wherein
the first connector is an adjustable ring.

19. The light bulb cooling device of claim 1 wherein the light bulb assembly further comprises
a light holder comprising
an enclosed electric box,
a plurality of curved fins;
a socket; and
a light bulb.

20. The light bulb cooling device of claim 19 wherein the electric box further comprises
an enclosed electric box comprising
a cylindrical housing,
a first cover plate, and
a second cover plate.

21. The light bulb cooling device of claim 1 wherein the outer tube further comprises
a reflective material, such that the reflective material reflects light from the bulb.

22. The light bulb cooling device of claim 1 further comprising
a pressure relief valve.

23. The light bulb cooling device of claim 1 further comprising
at least one hanging bracket.

* * * * *